340-566 SR
XR 4,017,842

[redacted]

United States Patent [19]

Vineyard

[11] 4,017,842

[45] Apr. 12, 1977

[54] SWIMMING POOL ALARM SYSTEM AND METHOD WITH ADJUSTABLE SENSITIVITY

[76] Inventor: Mark K. Vineyard, 1617 Fannin - Apt. 1114, Houston, Tex. 77002

[22] Filed: Oct. 21, 1974

[21] Appl. No.: 516,143

[52] U.S. Cl. ..... 340/261; 200/61.2; 200/84 R; 200/DIG. 8; 340/244 B; 340/279

[51] Int. Cl.[2] ..... G08B 21/00

[58] Field of Search ..... 340/261, 244 B, 421, 340/279; 200/61.53, 61.52, 61.2, DIG. 8, DIG. 45, 16 R, 84 R

[56] References Cited

UNITED STATES PATENTS

| | | | |
|---|---|---|---|
| 354,508 | 12/1886 | Fraleigh | 200/84 R |
| 996,170 | 6/1911 | Vannatter | 200/84 R |
| 1,081,843 | 12/1913 | Larson | 200/84 R |
| 1,307,086 | 6/1919 | Dijkstra | 200/84 R |
| 2,474,154 | 6/1949 | McCauley | 200/16 R |
| 2,774,058 | 12/1956 | Raichel | 340/261 |
| 3,058,101 | 10/1962 | Malvini | 340/261 |
| 3,155,952 | 11/1964 | Boehm et al. | 200/84 R |
| 3,482,237 | 12/1969 | Hamburg et al. | 340/261 |

*Primary Examiner*—Glen R. Swann, III
*Attorney, Agent, or Firm*—Bard, Springs, Jackson & Groves

[57] ABSTRACT

A swimming pool alarm system which is responsive to the height of waves resulting from unauthorized entry, and which includes provision for changing its sensitivity. An alarm circuit is provided with a switch having a plurality of stationary contacts spaces apart as a function of wave height, and another contact movable by a float positioned in the water. A switch is provided to select the stationary contact which corresponds to a preselected wave height of interest.

7 Claims, 7 Drawing Figures

SWIMMING POOL ALARM SYSTEM AND METHOD WITH ADJUSTABLE SENSITIVITY

BACKGROUND OF THE INVENTION

This invention relates to methods and apparatus for indicating the occurrence of an abnormal system parameter and, more particularly, relates to improved methods and apparatus for indicating the presence of an object in a body of water such as that contained in a swimming pool or the like.

It is well known that many private residences now have outdoor swimming pools located on the premises. In addition, many garden-type apartment houses and other multi-dwelling rental properties now have such pools available for use by their tenants. It is further well known that swimming pools constitute a hazard, not only for non-swimmers who may accidentally venture beyond wading depths, but also for experienced and normally capable swimmers who may become incapacitated by reason of accident or other sudden disability.

Because of these facts, it is conventional for the owners or operators of publically attended swimming pools to ban access thereto except when a "lifeguard" or other responsible attendant is available. Similarly, it is conventional for the owners of residential pools and the like to maintain such a restriction. On the other hand, it is obvious that the average owner of a residential or apartment house property does not have the capability of maintaining a 24-hour surveillance of his pool.

Because of this, and because of the fact that any swimming pool will potentially attract unauthorized users, many devices have been proposed for the purpose of generating an alarm in the event the pool is entered either accidentally or intentionally but without authorization. Security systems of the type intended to guard commercial establishments and the like are generally unsuitable for protecting a swimming pool, not only because they are far too complex and expensive, but also because such systems themselves require attendance by specially trained personnel. On the other hand, it will readily be apparent that any swimming pool alarm which is capable of attaining its purposes must itself be secure from being disconnected or disabled by unauthorized persons. In addition, however, such a system must not be subject to false alarms such as may be caused by wind blowing on the surface of the water in the pool.

PRIOR ART

Many attempts have been made to provide a swimming pool alarm which will not only provide a suitable indication of any unauthorized or unanticipated entry into the pool, which is relatively inexpensive as well as simple to install and operate, and which is also secure against tampering by persons seeking to disable or disconnect such an alarm. For example, in U.S. Pat. No. 2,774,058 (Raichel), there is depicted apparatus composed of a buoy-like structure adapted to float on the surface of the pool water, and a ball-type float mounted on one end of a lever. The other end of the lever is connected to the buoy to close a switch whenever a wave larger than a preselected magnitude shifts the vertical position of either the float or the buoy relative to each other. The buoy, in turn, is connected by the switch to an alarm located ashore and, presumably, in some remote location.

In U.S. Pat. No. 3,001,184 (Edelman), there is another type of swimming pool alarm wherein a self-contained alarm with switching circuit and power supply is located ashore, but wherein the switch is closed by a lever extending to a float member resting on the surface of the pool water. A novel feature of this device is that the float is relatively large and flat, whereby the float is not disturbed by ripples and other small waves caused by wind on the surfaces of the water, and whereby the diameter of the float determines the sensitivity of the device.

In U.S. Pat. No. 3,036,296 (Conte), there may be seen an alarm system composed of float-like member positioned buoyantly on the surface of the water and connected through a lever having its opposite end coupled to another float. Accordingly, whenever waves of a minimum preselected magnitude occur which cause one float to rise or fall with respect to the other, a switch is closed in the first float to actuate an alarm circuit positioned on the land.

In U.S. Pat. No. 3,054,096 (Peritz), there is depicted a fully self-contained and buoyant package adapted to float unmoored on the surface of the water. More particularly, a pendulum-type switch is contained therein for actuating an alarm whenever the package tilts to an angle greater than a preselected minimum because of waves on the surface of the water.

In U.S. Pat. No. 3,468,286 (Tetralt), there is provided a buoyant housing containing a gas-operated horn or other audible signal, which is adapted to float unmoored on the surface of the water in the pool. An immersed vane-like member is flexibly suspended from the housing in a manner such that it tends to resist being drawn through the water. Accordingly, if a wave lifts the buoyant housing far enough above the relatively immobilized vane, the gas-operated horn will actuate.

In U.S. Pat. No. 3,683,353 (Miller), a small sensing unit is suspended in the water in a manner to normally float upright while the water is undisturbed. A pendulum-type switch is disposed within a ring in the sensor, whereby an alarm is actuated whenever the pendulum wobbles against the ring due to disturbance of the surface of the water. The pendulum is adjustable to hang at a selective height within the ring, to provide adjustable sensitivity for the system.

In U.S. Pat. No. 3,732,556 (Caprillo), an alarm circuit is coupled to a pair of strip-type electrodes spaced one above the other and fixed about the inner periphery of the pool and just above the surface of the water. Accordingly, any disturbance in the water of the type sought to be detected will cause the water to lap up over both electrodes to momentarily close the circuit and to thereby actuate the alarm. The spacing between the upper and lower electrodes determines the sensitivity of the system, inasmuch as lapping onto only the lower of the two electrodes will not close the circuit.

In U.S. Pat. No. 3,757,318 (Brisson), a detector system is provided with a ball-type float which is slidably mounted on a vertical shaft, and a spring-loaded normally open switch is mounted above the float. Disturbances in the surface of the water cause the float to move up and against the switch. Due to the mass of the switch, however, only a relatively large disturbance will drive the float upward with sufficient impact to close the switch.

In U.S. Pat. No. 3,786,469 (Massaro), a detector system includes a buoyant housing containing a pendulum-type actuating switch and a radio transmitter. The switch wobbles in response to disturbances in the water to energize the transmitter.

In U.S. Pat. No. 3,482,237 (Hamburg, et al.), there is depicted a float-actuated alarm system which is also responsive to disturbances in the water and which also includes provision for making the system responsive only to waves greater than a preselected minimum magnitude. Sensitivity of the detector portion of the system, which is mounted on or in the side of the swimming pool, is dependent on the size of the opening in the bleed valve 102, and also upon the setting of the set screw 74.

Although each of these systems is clearly capable of indicating the presence of unauthorized persons in a pool, each of these systems also contains one or more disadvantages which keep them from enjoying significant acceptance by pool owners. The Massaro system requires a radio receiver device to receive the alarm signal generated by his transmitter, and a receiver circuit of this type is clearly responsive to spurious signals from other sources. The Brisson and Miller systems are clearly subject to tampering, and the Caprillo system is obviously expensive to install. The Tetralt and Peritz devices, on the other hand, are both complex pieces of apparatus which are clearly expensive to build and maintain.

Another more important limitation, however, involves the matter of sensitivity of any device which is responsive to a disturbance of the surface of the water. It will be obvious, of course, that the surface of the water is rarely ever glassy smooth, and that gusts of wind will cause waves therein. Accordingly, the detector must be sensitive to only disturbances of the type produced by unauthorized or unanticipated entry into the pool, since false alarms are as unwanted as a failure to indicate unauthorized entry.

All of the foregoing systems of the prior art include provision for making the system responsive only to waves of at least a predetermined magnitude. In Edelman, Conte, Caprillo and Brisson, however, the sensitivity of the system is built into it and cannot be varied as needed. Accordingly, if winds occur which are strong enough to actuate the detector, the only recourse is to deactivate the entire system until the storm concludes.

The systems provided by Massaro, Miller, Tetralt, Peritz, Hamburg et al. and Raichel each include provision for varying the sensitivity of the detector. In each case, however, it is necessary to deactivate the entire system and remove the detector from the water before its sensitivity can be adjusted. Moreover, it will be readily apparent from only a cursory examination of each of these references that varying sensitivity of each of these systems requires a full knowledge of its inner workings and, except for Raichel, substantial disassembly of the entire assembly.

These disadvantages of the prior art are overcome with the present invention, and improved swimming pool alarm methods and apparatus are herewith provided which are responsive to a disturbance of the surface of the water but which also include provision whereby sensitivity may be selectively adjusted without the necessity of either deactivating the system or even removing its sensor from the water.

SUMMARY OF THE INVENTION

In an ideal embodiment of the present invention, a swimming pool alarm system is provided which comprises a sensor device adapted to respond to disturbance of the surface of the water, an electrically actuated alarm circuit incorporating means for generating an audible signal and located at some point remote from the pool, and a multi-conductor cable of suitable length for interconnecting the sensor and the alarm circuit. The sensor includes a float or other buoyant member arranged at one end of a suitable lever arm, means for releasably clamping the lever arm pivotally to the side or upper edge of the pool, an electrical switch contact at the opposite end of the lever arm and connected with the alarm circuit by way of the cable, and means establishing a plurality of other switch contacts in proximity to the contact on the switch arm, whereby the circuit is closed whenever movement of the float brings the first or movable switch contact into with one or another of the group of second or stationary contacts.

It is a feature of the present invention that each of the plurality of stationary contacts in the sensor device is arranged to be engaged by the movable contact by a different magnitude of arcuate movement of the lever arm supporting the float. In other words, if the float rises or falls as a result of the occurrence of a wave of a first minimum magnitude, the movable contact will be only brought into engagement with the first or nearest of the three stationary contacts. If a wave or intermediate magnitude appears, however, then the movable contact will be shifted past the nearest of these stationary contacts to engage the next closest of the three stationary contacts. On the other hand, if a wave of a third or maximum magnitude occurs, then the float will cause the lever to swing the movable contact past both the nearest and the next nearest of the three stationary contacts or electrodes to engage the third or furthest electrode.

Each of these three stationary contacts or electrodes is interconnected with the alarm circuit by a separate different conductor in the cable and to a selector switch which, in turn, is interconnected through the alarm circuit to another separate conductor extending through the cable to the movable contact on the end of the lever arm. Accordingly, the selector switch is positioned to connect the appropriate one of the three or more stationary electrodes, since the alarm circuit will only be actuated if the movable contact is brought into engagement with the stationary contact which has been selected by the selector switch.

More particularly, if only light breezes are present to produce only small ripples and the like in the surface of the water, and if a high degree of sensitivity is accordingly desired, the selector switch is preferably positioned to select the stationary contact which is closest to the movable contact. Thus, only a relatively minor disturbance of the water will produce a wave of a height sufficient to shift the movable contact into engagement with this nearest stationary contact.

If, on the other hand, heavy wind gusts are occurring which are strong enough to produce a significant disturbance of the water, the selector switch is preferably moved to select either the intermediate or even the furthest of the three stationary contacts in the sensor device. Thus, the alarm will not be actuated when the bobbing float causes the lever arm to bring the movable contact into engagement with the nearest of these three stationary contacts.

It is also a feature of the present invention to locate the selector switch in the alarm circuit which, in turn, is located remotely of the sensor device clamped on the side of the pool. Thus, sensitivity of the system may be adjusted as desired, without having any special knowledge of the internal workings of the system, and especially without the necessity of either removing the sensor from the water or poolside or disabling the system at any time.

It is a further feature of the present invention to provide for actuation of the alarm circuit by either upward or downward movement of the float in the water. Each of the three or more stationary contacts are in the form of U-shaped electrodes which are each located so that its two arms or extensions are located respectively above and below the movable contact when the float is motionless in the pool. If the float rises because of a swell or other wave in the water, the movable contact will move down to engage the lower of the two arms or extensions of the stationary contact which has been chosen by the setting of the selector switch. If the float drops, however, the movable contact will accordingly rise to engage the other or upper of the two extensions.

It is another feature of the present invention to provide means whereby the system is secure against being tampered with by children or other persons of only ordinary skill or experience with security-type systems. The alarm circuit includes a latching mechanism whereby the audible signal will continue to be produced even though the movable contact has moved only momentarily into engagement with the selected stationary contact. In addition, the lever arm is provided with a special configuration as hereinafter described, whereby only slight movement of the lever arm (such as will inherently occur if an attempt is made to unclamp and remove the sensor device from the side of the pool) will cause the movable contact to engage the selected stationary contact.

These and other features and advantages of the present invention will become apparent from the following detailed description, wherein reference is made to the figures in the accompanying drawings.

IN THE DRAWINGS

DETAILED DESCRIPTION

Figure 1:
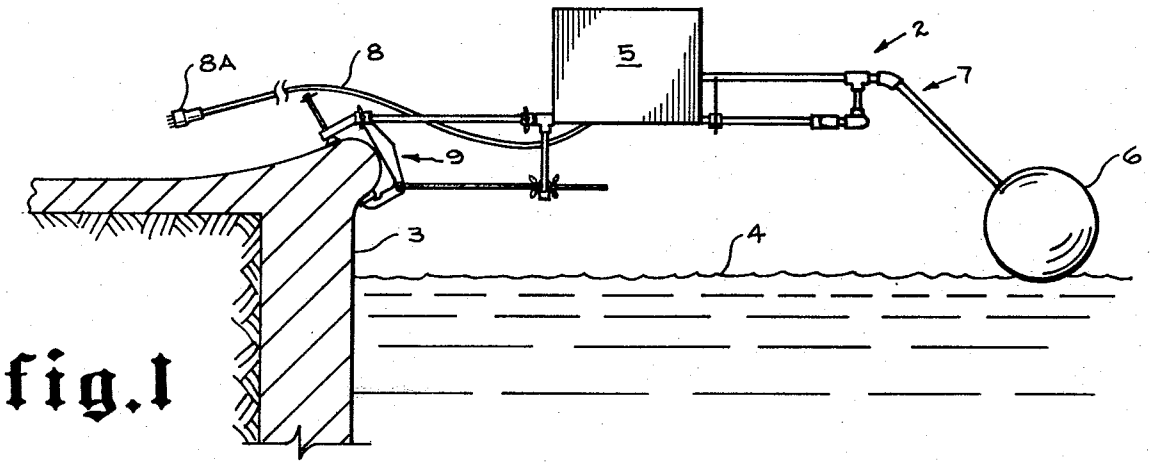
FIG. 1 is a simplified pictorial representation of the detector portion of a swimming pool security system exemplifying the concept of the present invention.

Referring now to FIG. 1, there may be seen a simplified pictorial representation of a detector assembly 2 which is intended to announce the unauthorized or unexpected entry of persons into the water in a swimming pool and the like. More particularly, the detector apparatus 2 may be seen to be composed of a switch assembly 5 which is actuated by a float 6 buoyantly supported by the water 4, and which is further mounted on the free traveling end of an arm assembly 7. As may also be seen, the switch assembly 5 is conveniently provided with a clamp assembly 9 which may be releasably secured to the edge 3 or other suitable portion of the swimming pool. In addition, a cable 8 and plug 8A may be included for interconnecting the switch assembly 5 to an alarm means (not depicted in FIG. 1) preferably located at a remote observation site, as will hereinafter be explained.

Figure 2:
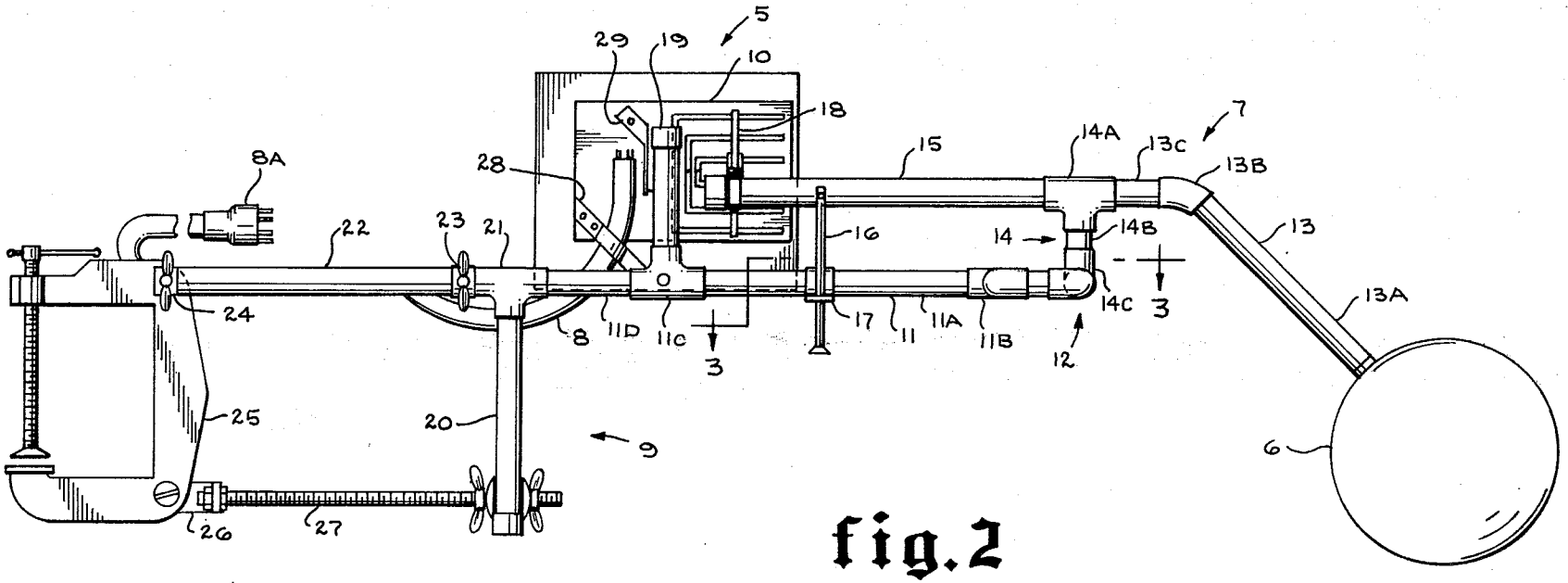
FIG. 2 is a more detailed pictorial representation of the apparatus depicted generally in FIG. 1.

Referring now to FIG. 2, there may be seen a more detailed pictorial representation of the apparatus illustrated in FIG. 1. More particularly, the switch assembly 5 may be seen to be composed of a printed circuit board 10 which has a plurality of U-shaped electrodes arranged above and below a neutral or reference point, and interconnected with appropriate ones of the leads or conductors in the cable 8, as will hereinafter be explained. The printed circuit board 10 is supported by means of a bracket 29 attached to a vertical post 19 which, in turn, is mounted on a tubular T-member 11C. In addition, the printed circuit board 10 is further supported by means of a second support bracket 28 which extends from the circuit board 10 to the T-member 11C and which is also adapted to secure the end of the cable 8 to the circuit board 10.

Referring again to FIG. 2, the arm assembly 7 may be seen to be composed of a pivot arm section 15 having one end located adjacent the electrodes on the near side of the printed circuit board 10 and having its other end fixed to a T-support assembly 14 which, in turn, is pivotally mounted on a pivot joint 12 at the end of a supporting bracket 11. The other portion of the arm assembly 7 may be seen to be composed of a dog leg extension 13 which is fixed at one end to the T-support assembly 14 and at the other end to the float member 6. Accordingly, it will be apparent that disturbances in the surface of the water 4 will cause the float member 6 to rise and fall proportionally to the magnitude of such disturbances and that this, in turn, will cause the pivot arm 15 to move arcuately up and down across the face of the printed circuit board 10 and the various electrodes displayed thereon.

Referring again to FIG. 2 it may be seen that the dog leg portion 13 of the arm assembly 7 is composed of a straight section of tubing 13A interconnected at one end to the float member 6 and at the other end to a short eighth-turn 13B. In addition, a shorter length of tubing 13C fixedly interconnects the eighth-turn 13B to a T-member 14A in the T-support assembly 14.

The function of the T-support assembly 14 is to pivotally mount the arm assembly 7 so that the free traveling and arcuately movable end of the pivot arm 15 is normally positioned at a reference point which, in turn, is preferably equally spaced between the upper and lower branches of the nearest electrode displayed on the printed circuit board 10, as will hereinafter be explained. Accordingly, the T-support assembly 14 is composed of the T-member 14A and a short nipple 14B which, in turn, is interconnected with a second inverted T-member 14 rotatably interconnected with the pivot joint as will hereinafter be explained with respect to FIG. 3.

Figure 3:
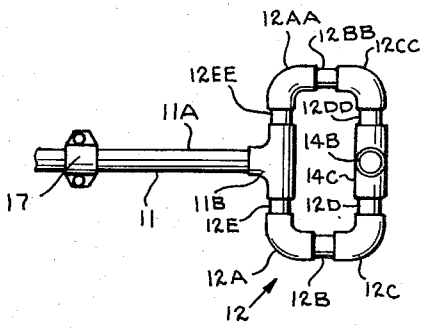
FIG. 3 is a pictorial representation of the details of a portion of the apparatus represented in FIGS. 1 and 2.

Referring now to FIG. 3, there may be seen a more detailed pictorial representation of the various component parts of the pivot joint 12 illustrated in FIG. 2. More particularly, the pivot joint 12 may be seen to include a pair of short nipples 12D and 12DD, each having one end rotatably connected to the T-member 14C and their opposite ends fixedly connected to one end of each of a pair of tubular L-members 12C and 12CC. The opposite ends of the two L-members 12C and 12CC are, in turn, fixedly joined to one end of each of a second pair of short nipples 12B and 12BB which, in turn, each have their opposite ends fixedly joined to one end of each of a second pair of L-members 12A and 12AA. The pivot joint, in turn, is connected to the supporting bracket 11 by another pair of short nipples 12E and 12EE which are each fixedly connected to the opposite ends of the second pair of L-members 12A and 12AA.

Referring again to FIG. 2, the supporting bracket 11 may be seen to be composed of a long nibble 11A having one end fixedly coupled to the T-member 11C supporting the post 19 and having its opposite end coupled to a T-member 11B which, in turn, is fixedly connected to the nipples 12E and 12EE in the pivot joint 12. The T-member 11C, in turn, is provided with a shorter nipple 11D which is fixedly attached to the clamp assembly 9, as will hereinafter be explained.

Referring again to FIG. 2, it will be seen that the purpose of the configuration provided for the arm assembly 7 is to maintain the free traveling end of the pivot arm 15 at the aforementioned reference point when the float member 6 is resting substantially undisturbed on the surface of the water 4. If the surface of the water 4 is disturbed in a manner sought to be detected, the float member 6 will oscillate up and down to cause the pivot arm to move either up or down from the reference point to engage a selected one of the electrodes displayed on the printed circuit board 10, and to thereby provide a suitable announcement, as will hereinafter be explained in detail. It will be apparent that in order for the apparatus depicted in FIG. 2 to be properly sensitive to such disturbances, the arm assembly 7 must be relatively sensitively balanced upon the supporting bracket 11 by means of the pivot joint 12 and T-support member 14. It will also be apparent that if the detector assembly 2 is moved out of the water 4, there will be a tendency for the arm assembly 7 to swing throughout a relatively wide limit of arcuate movement, thereby risking damage to the apparatus. This exigency is preferably provided against by providing a downwardly extending pair of limit rods 16 and 16A which are pivotally attached to the pivot arm 15, as depicted in FIG. 2, and which extend slidably through a bracket 17 mounted on the long nipple 11A of the supporting bracket 11, as illustrated in FIGS. 2 and 3. In other words, the limit rods 16 and 16A may only be drawn upward through the bracket 17 to the extent of their length because of their enlarged ends. Accordingly, the arm assembly 7 can only move arcuately as permitted by the limit rods 16 and 16A and counterclockwise until the free traveling end of the pivot arm 15 engages the supporting bracket 11.

Referring again to FIG. 1, it will be seen that the illustrated detector assembly 2 is preferably adapted to be releasably secured to a convenient portion of the pool, such as its edge 3, whereby the detector assembly 2 may be removed whenever desired and whereby it may also be conveniently reconnected whenever desired. It will also be apparent that although the aforementioned reference point is constant insofar as the workings of the detector assembly 2 are concerned, it will be determined by the height of the water 4 in the pool with respect to the mooring point of the detector assembly 2. Since the level of the water 4 may vary from time to time, the clamp assembly 9 is preferably adapted to permit the detector assembly to be located at various positions relative to the surface of the water 4.

Referring to FIG. 2, therefore, it will be seen that the clamp assembly 9 is preferably composed of a conventional C-clamp 25 which is pivotally mounted at one end to an angle bracket 26 which, in turn, is threadedly attached to the end of a threaded rod 27 having its other end threadedly inserted transversely through the lower end of a vertical support member 20. The support member 20, in turn, is fixedly attached at its upper end to a T-member 21 connected, in turn, to the short nipple 11D of the supporting bracket 11. In addition, the C-clamp 25 is also pivotally connected at its upper end to one end of a nipple 22 having its other end slidably inserted into the T-member 21. It will be apparent, therefore, that the position of the C-clamp 25 may be varied to and from the vertical support 20 by rotation of the threaded rod 27 and also by sliding the nipple 22 in or out of the adjacent end of the T-member 21. Alternatively, the C-clamp 25 may be rotated with respect to either the nipple 22 or the threaded rod 27. Accordingly, a wing nut 24 or other suitable means is preferably provided for releasably fixing the C-clamp 25 to the adjacent end of the nipple 22, and a similar wing nut 23 is preferably provided for releasably securing the opposite end of the nipple 22 in the T-member 21.

Figure 4:
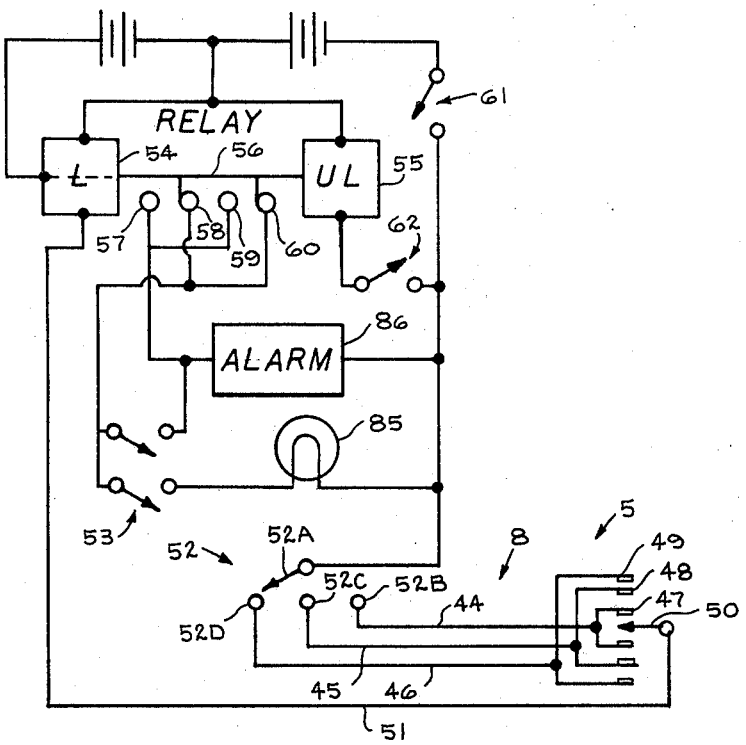
FIG. 4 is a simplified schematic representation of the electrical circuitry employed in one embodiment of a swimming pool security system embodying the concept of the present invention.

Referring now to FIG. 4, there may be seen a simplified schematic representation of the electric circuitry preferably provided in an ideal embodiment of the present invention. More particularly, there may be provided a set of three electrodes 47–49 corresponding to the electrodes displayed on the printed circuit board 10, as hereinbefore stated, and each having upper and lower branches mounted at different spacings on opposite sides of a movable electrode 50 which, in turn, is mounted on the free traveling end of the pivot arm 15, as will hereinafter be explained. The electrode 47 having its two branches located nearest to the movable electrode 50 (and to the reference point, of course) is coupled to a conductor 44 in the cable 8 which, in turn, is connected to terminal 52B of a selector switch 52 in an annunciator section located at a remote observation point. The next closest electrode 48 is, in turn, connected to terminal 52C of the selector switch 52 by conductor 45 in the cable 8, and the farthest electrode 49 is connected to terminal 52D by the conductor 46 in the cable 8. The movable electrode 50, in turn, is coupled by conductor 51 in the cable to the latching coil 54 of a relay having an unlatching coil 55 and a movable relay contact arm 56. The annunciator section further includes a master switch 61 for connecting power to its internal components, a reset switch 62 interconnected between the master switch 61 and the unlatching coil 55, a suitable alarm 86 (which is a horn, buzzer, bell, etc.) which is coupled between the master switch 61 and contacts 57 and 59 of the relay, and a test indicator such as a neon lamp 85 which is coupled between the master switch 61 and a test switch 53 interconnected between the alarm 86 and contacts 58 and 60 of the relay.

Referring to FIG. 4, when the master switch 61 is closed, power will be connected to the normally open reset switch 62, the alarm 86, the lamp 85 and the switch arm 52A of the selector switch 52. Power will also be connected to both the latching and unlatching coils 54 and 55 of the relay, and to the movable electrode 50 by way of conductor 51 in the cable 8. Since the relay is normally in an unlatched position, power will only be supplied to one side of the alarm 86. If the switch arm 52A is moved to the contact 52D, power will not reach the alarm 86 if the movable contact 50 shifts into engagement with either the near electrode 47 or the intermediate electrode 48. If the movable electrode 50 engages the far electrode 49, however, this will close the circuit from the master switch 61 to the latching coil 54, whereby power may be connected through contacts 57 and 59 in the relay to energize the alarm 86. Furthermore, the relay will remain in its latched position, notwithstanding that the movable electrode 50 may have only momentarily engaged the far electrode 49. Consequently, the reset switch 62 must be closed to connect power through the unlatching coil 55 (by way of the latching coil 54) to shift the two contacts on the relay contact arm 56 back to contacts 58 and 60.

The purpose of the test switch 53 is to provide means for actuating the alarm 86 in order to establish the operability of the circuitry depicted in FIG. 4, and also to test the potency of the power supply. Accordingly switch 53, which is preferably spring-loaded in an open position, may be closed to connect power from the master switch 61 through the lamp 85 to the opposite side of the alarm 86. It will be apparent that actuation of the alarm 86 will establish both the operability of the annunciator circuit and the potency of the power supply. It will also be apparent that the circuitry may be operable but that the power supply may be too weak to trigger or otherwise actuate the alarm 86. This condition will become apparent if the alarm 86 fails to actuate upon closure of the test switch 53 but the lamp 85 is nevertheless illuminated, since the lamp is preferably selected to operate with only a low voltage or wattage input. If a more precise measurement of the actual voltage is desired, then a conventional voltmeter may be substituted for the lamp 85 indicated in FIG. 4.

Figure 5:
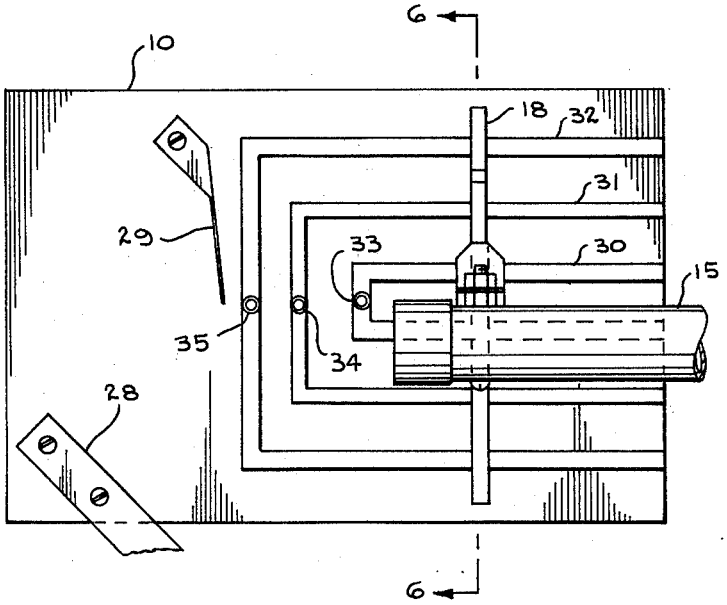
FIG. 5 is a more detailed pictorial representation of a portion of the apparatus depicted generally in FIGS. 2 and 4.
Figure 6:
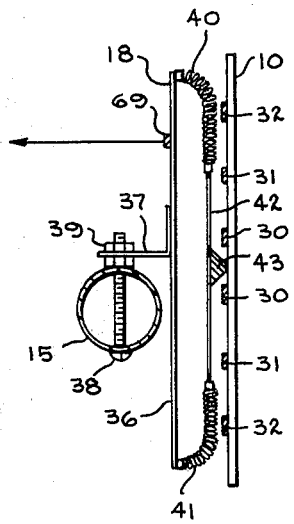
FIG. 6 is a different pictorial view of apparatus represented in FIGS. 4 and 5.

Referring now to FIGS. 5 and 6, there may be seen a more detailed pictorial representation of both the free traveling end of the pivot arm 15 and the printed circuit board 10 which is arranged adjacently thereto. More particularly, it will be seen that the printed circuit board 10 displays a set of U-shaped electrodes 30–32 which, in turn, correspond to the electrodes 47–49 in FIG. 4 and which are provided with suitable terminals 33–35 for interconnection with the conductors 44–46 in the cable 8. The free traveling end of the pivot arm 15 is provided with a contactor assembly 18 which corresponds functionally to the movable electrode 50 in FIG. 4 and which, therefore, is adapted to electrically engage one or another of the electrodes 30–32 depending upon the extent of arcuate movement of the pivot arm 15.

As may be seen in FIGS. 5 and 6, the contactor assembly 18 is preferably formed with a support bracket 36 fixedly mounted on an angle bracket 37 which, in turn, is secured to the free traveling end of the pivot arm 15 by means of a screw 38 and nut 39. The support bracket 36 is preferably formed of an electrically conductive material whereby power may be received to this component through terminal 69 which, in turn, is electrically connected to conductor 51 in the cable 8, as indicated in FIG. 4. Accordingly, the angle bracket 37 is preferably formed of a non-conductive material or is otherwise suitably insulated, whereby electric power may be isolated from the pivot arm 15. The component which actually engages the electrodes 30–32 is the contactor 43. In order to assure engagement between the contactor 43 and the selected one of the electrodes 30–32, therefore, the contactor 43 is preferably mounted between a pair of springs 40 and 41 which, in turn, are fastened to the opposite ends of the support bracket 36.

Figure 7:
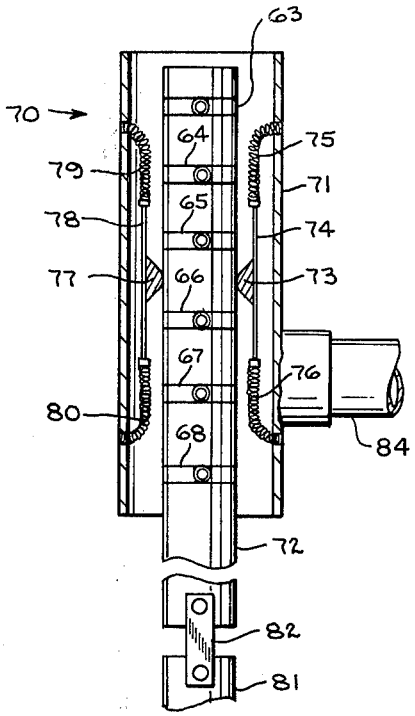
FIG. 7 is a pictorial representation, partly in cutaway, of another form of switching apparatus suitable for use in the circuitry depicted in FIG. 4.

Referring now to FIG. 7, there may be seen a detailed pictorial representation of another form of switch 70 suitable for use in the present invention and more particularly including a non-metallic shaft-like arm 72 disposed generally longitudinally within a non-metallic sleeve number 71. As further indicated, the arm member 72 is provided with a plurality of circular band-like electrodes 63–68 disposed about its circumference, as indicated in FIG. 7. Accordingly, the sleeve member 71 is preferably provided with one or more contactor assemblies of the type depicted in FIG. 6. More particularly, one contactor may be seen to include a contactor support 74 interconnected between a pair of springs 75 and 76 for urging its contactor 73 against the adjacent surface of the arm member 72. Similarly, another contactor support member 78, which is disposed between springs 79 and 80, is provided with a contact point 77 urged against the opposite side of the arm member 72.

In the concept of the invention embodied in FIG. 7, either the arm 72 is movable and the sleeve member 71 is stationary, or the sleeve member 71 is movable with respect to the fixedly positioned arm 72. If the arm member 72 is substituted for the free traveling end of the pivot arm 15 in FIG. 2, and if the sleeve member 71 is substituted for the fixedly positioned printed circuit board 10, then the arm member 72 is preferably pivotally connected to the end of the pivot arm 15 by means of a flexible link 82 in order that the arm member 72 will maintain longitudinal alignment within the sleeve member 71, notwithstanding arcuate movement of the pivot arm 15. In this respect, the arm 81 depicted in FIG. 7 will functionally correspond to the pivot arm 15.

Referring again to FIG. 7, if the arm 84 is functionally related to the pivot arm 15, and if the sleeve member 71 fixed thereon is accordingly moved arcuately up and down around a fixedly positioned arm member 72, it will be apparent that the inner surface of the sleeve member 71 will engage and bind against the surface of the arm member 72. To avoid incurring this limitation, therefore, it is preferable that the arm member 72 be pivotally mounted on the end of a fixedly positioned arm member 81, by means of the flexible link 82, whereby the arm member 72 may move arcuately in a horizontal direction in response to vertical arcuate movement of the sleeve member 71.

It will be apparent that, in addition to the alternatives hereinbefore mentioned, the electrodes 63–68 may be relocated to encircle the inside surface of the sleeve member 71. In such an arrangement, of course, the two contactor assemblies depicted in FIG. 7 will be removed from the sleeve member 71 and remounted along the sides of the arm member 72.

Although the switching assemblies depicted in FIGS. 4–7 have previously been discussed with respect to a security system for a swimming pool and the like, it will be readily apparent that such switches have useful applications in any type of system wherein arcuate mechanical movement is generated in response to, or in functional proportion to, one or more different operating parameters of such a system. In such a case, it is only necessary to provide that the various electrodes are each spaced from a preselected reference or null point a distance which is functionally related to the magnitude or some other measurable characteristic of a selected one of such parameters.

Referring again to FIG. 2, it will be apparent that the float member 6 will travel a distance up or down which is equal to the magnitude of the disturbance or other parameter sought to be measured, whereas the free traveling end of the pivot arm 15 travels a much smaller distance across the face of the printed circuit board 10. This is because it is inconvenient for the pivot arm 15 to move through arcuate sweeps as great as those experienced by the float 6, and thus the length of the pivot arm 15 is only a preselected fraction of that of the dogleg extension 13 which supports the float member 6. Accordingly, it will be apparent that the spacing of the electrodes on the printed circuit board 10, relative to the reference location, is functionally related to the proportionality of the length of the pivot arm 15 with respect to the length of the dogleg extension 13.

Although the invention has been illustrated and described in connection with a single specific embodiment, it is to be understood that the inventive concept is not limited to the specific structure shown. All forms of the invention embraced within the language of the following claims is within the spirit of the invention and should be so understood.

What is claimed is:

1. A security system for a swimming pool and the like, including a detector section having a plurality of stationary electrodes spaced different predetermined distances from a reference point functionally related to the normal water level in said pool and further having a contactor electrode movable toward said stationary electrodes through distances functionally related to the heights of disturbances of the surface of the water in said pool, an electrical cable extending from said detector section to an observation site and having a plurality of conductors each connected to a different one of said electrodes in said detector section, an alarm section located at said observation site and having a selector switch interconnected with said conductor coupled to said movable electrode and connectable to a selected one of said conductors coupled with said stationary electrodes, said detector section further comprising an arcuately movable lever arm having said contactor electrode fixed to one end for positioning at a reference location relative to said stationary electrodes, a bouyant member fixed to the other end of said lever arm for disposition in said water, and attachment means for pivotally supporting said lever arm adjacent the side of said swimming pool directing movement of said contactor arcuately in a generally vertical plane relative to said surface of said water in said pool.

2. The security system described in claim 1, wherein each of said stationary electrodes has an upper branch spaced a preselected distance above said reference location and a lower branch spaced an equal preselected distance below said reference point.

3. The security system described in claim 2, wherein there are at least three stationary electrodes and wherein the nearest of said stationary electrodes has its upper and lower branches each spaced a first preselected distance from said reference location functionally related to disturbances in the surface of said water of a first predetermined magnitude relative to the normal height of said surface, wherein the intermediate of said stationary electrodes has its upper and lower branches each spaced a second preselected distance from said reference location greater than said first distance and functionally related to disturbances in the surface of said water of a second predetermined magnitude relative to the normal height of said surface greater than said first predetermined magnitude, and wherein the farther of said stationary electrodes has its upper and lower branches each spaced a third preselected distance from said reference location greater than said first and second distances and functionally related to disturbances in the surface of said water of a third predetermined magnitude relative to the normal height of said surface greater than said first and second predetermined magnitudes.

4. The security system described in claim 3, further including signalling means for producing an audible output signal, and latching means responsive to momentary engagement of said contactor electrode and said selected one of said stationary electrodes for activating said signalling means.

5. A security system for a swimming pool and the like, comprising detector means having a plurality of pairs of electrodes spaced different predetermined distances from a reference point and a contactor movable into engagement with said electrodes in response to waves in said pool of preselected heights functionally related to said preselected distances, an electrical cable extending from said detector means to a selected observation site and having a conductor connected to said contactor and a plurality of separate other conductors each connected to a different one of said pairs of electrodes, and alarm means located at said observation site and coupled to and having provision for coupling said alarm means to a selected one of said conductors connected to said pairs of electrodes.

6. The system described in claim 5, wherein said contactor is arcuately movable in response and through a distance functionally related to the magnitude of any disturbances in the surface of the water in said swimming pool.

7. The system described in claim 6, wherein said electrodes are each spaced from said reference point in functional relationship to disturbances of different preselected magnitude.

* * * * *